US009708872B2

(12) United States Patent
O'Neal et al.

(10) Patent No.: US 9,708,872 B2
(45) Date of Patent: Jul. 18, 2017

(54) CLEAN OUT SUB

(71) Applicant: WWT NORTH AMERICA HOLDINGS, INC., Houston, TX (US)

(72) Inventors: Eric John O'Neal, Mission Viejo, CA (US); Rudolph Ernst Krueger, V, Aliso Viejo, CA (US); Andrew Alexander Trowbridge, Anaheim, CA (US)

(73) Assignee: WWT North America Holdings, Inc, Houston, TX (US)

( * ) Notice: Subject to any disclaimer, the term of this patent is extended or adjusted under 35 U.S.C. 154(b) by 474 days.

(21) Appl. No.: 14/295,861

(22) Filed: Jun. 4, 2014

(65) Prior Publication Data

US 2014/0374157 A1 Dec. 25, 2014

Related U.S. Application Data

(60) Provisional application No. 61/836,951, filed on Jun. 19, 2013.

(51) Int. Cl.
*E21B 21/10* (2006.01)
*E21B 37/00* (2006.01)
(Continued)

(52) U.S. Cl.
CPC ..... *E21B 21/103* (2013.01); *E21B 34/10* (2013.01); *E21B 37/00* (2013.01); *E21B 2034/007* (2013.01)

(58) Field of Classification Search
CPC .. E21B 21/10; E21B 21/103; E21B 2034/007; E21B 34/10; E21B 37/00
See application file for complete search history.

(56) References Cited

U.S. PATENT DOCUMENTS 4,232,701 A 11/1980 Adachi
4,254,799 A 3/1981 Blatt
(Continued)

FOREIGN PATENT DOCUMENTS

EP 0 145 436 A2 6/1985
IN 217814 10/2008
WO WO 2010/143000 A2 12/2010

OTHER PUBLICATIONS

Churchill Drilling Tools. Four "Smart Dart™ Movies" entitled as follows: 1) DAV MS™ CircSub & Alternative Diverter Dart; 2) DAV MS™ CircSub & Standard Diverter Dart; and 3) DAV MAS™ CircSub & Split Flow Dart, all available at http://www.circsub.com/august2011.dart_movies.htm (screen capture of website entry to view movies created Aug. 30, 2014, 2 pages), copyright Churchill Drilling Tools, 2011.

(Continued)

*Primary Examiner* — David Andrews
*Assistant Examiner* — Tara Schimpf
(74) *Attorney, Agent, or Firm* — Lewis Roca Rothgerber Christie LLP

(57) ABSTRACT

A clean out sub for use in a drill string having a tool body with a cavity for passage of drilling fluid and annular fluid circulation ports extending through the tool body, a valve spool is positioned within the tool body cavity having a reduced diameter orifice, a compression spring is located within the tool body cavity adjacent the valve spool, wherein a drop in fluid pressure created by the orifice imparts a downhole force on the valve spool and at a predetermined force overcomes a set resistive force of the compression spring thereby moving the valve spool to open the annular fluid circulation ports.

20 Claims, 4 Drawing Sheets

(51) Int. Cl.
*E21B 34/10* (2006.01)
*E21B 34/00* (2006.01)

(56) References Cited

U.S. PATENT DOCUMENTS

| | | | | |
|---|---|---|---|---|
| 4,257,456 | A | 3/1981 | Elliston | |
| 4,362,183 | A | 12/1982 | Richter et al. | |
| 4,573,536 | A | 3/1986 | Lawrence | |
| 4,768,598 | A | 9/1988 | Reinhardt | |
| 5,318,127 | A | 6/1994 | Hines et al. | |
| 5,465,787 | A | 11/1995 | Roth | |
| 6,102,126 | A | 8/2000 | Huber et al. | |
| 6,109,354 | A | 8/2000 | Ringgenberg et al. | |
| 6,173,795 | B1 | 1/2001 | McGarian et al. | |
| 6,263,969 | B1 * | 7/2001 | Stoesz | E21B 21/103 137/115.08 |
| 6,675,897 | B1 | 1/2004 | McGarian et al. | |
| 6,820,697 | B1 | 11/2004 | Churchill | |
| 6,889,771 | B1 | 5/2005 | Leising et al. | |
| 6,899,179 | B2 | 5/2005 | McGarian et al. | |
| 7,011,157 | B2 | 3/2006 | Costley et al. | |
| 7,243,727 | B2 | 7/2007 | Tudor et al. | |
| 7,322,419 | B2 | 1/2008 | Carmichael | |
| 7,337,847 | B2 | 3/2008 | McGarian et al. | |
| 7,392,849 | B2 | 7/2008 | Lauderdale et al. | |
| 7,520,333 | B2 | 4/2009 | Turner et al. | |
| 7,644,766 | B2 | 1/2010 | Begley et al. | |
| 7,655,096 | B2 | 2/2010 | Walker et al. | |
| 7,789,163 | B2 | 9/2010 | Kratochvil et al. | |
| 7,806,184 | B2 | 10/2010 | Schultz et al. | |
| 7,866,402 | B2 | 1/2011 | Williamson, Jr. | |
| 7,926,573 | B2 | 4/2011 | Swan et al. | |
| 7,987,915 | B1 | 8/2011 | Wiggins et al. | |
| 8,037,940 | B2 | 10/2011 | Patel et al. | |
| 8,096,363 | B2 | 1/2012 | Williamson, Jr. | |
| 8,201,633 | B2 | 6/2012 | Hilliard | |
| 8,251,154 | B2 | 8/2012 | Duphorne | |
| 2006/0011354 | A1 | 1/2006 | Logiudice et al. | |
| 2006/0225885 | A1 * | 10/2006 | Mcgarian | E21B 23/006 166/334.4 |
| 2011/0272044 | A1 | 11/2011 | Bolyard, Jr. | |
| 2014/0020955 | A1 | 1/2014 | Cramer et al. | |

OTHER PUBLICATIONS

"MOCS—*Multiple Opening Circulation Sub, Fluid Bypass Valve*", Downhole MOCS™ Tool, www.nov.com (19 pages).

"*Wellbore Integrity. Advanced Technologies, Solutions Are Improving Wellbore Construction. One case history outlines the challenges of drilling well pairs from a pad in a stream assisted gravity drainage field*". Advances in Drilling, Apr. 2012, www. Hartenergy. com (pp. 21-24).

"*Multicycle Circulating Valve with Lock Module, Insensitive to pressure surges in tubing and annulus when lock is engaged*". Schlumberger (informational flyer), 2 pages.

Multicycle Circulating Valve, High-flow-rate circulation for milling, Schlumberger (information flyer), www.slb.com/CoilTOOLS, 1 page.

DSI PBL Bypass Systems. "*The PBL Sliding Sleeve Big Bore System*", informational flyer, 1 page.

X Drilling Tools. TAZ® Multiple Activation Circulation Sub*, informational flyer, www.xdrilling.com, 2 pages.

Summit Casing Equipment. "Introducing the New TorqGlider Composite Centralizer", www.summitcasing.com, informational flyer, 1 page.

Office action and Examination Search Report issued in parallel Canadian Patent Application No. 2,854,311 on Aug. 18, 2015; 5 pages.

* cited by examiner

CLEAN OUT SUB

CROSS-REFERENCE TO RELATED APPLICATION(S)

This Patent Application claims priory to and the benefit of U.S. Provisional Patent Application Ser. No. 61/836,951, filed on Jun. 19, 2013, entitled CLEAN OUT SUB, the entire content of which is hereby expressly incorporated by reference.

BACKGROUND OF THE INVENTION

Wells are drilled with a fluid driven motor affixed to the lower end of a drill pipe. Drilling fluid is pumped down through the drill pipe by pumps situated at the surface of the drill string. The drilling fluid pumped downhole through the drill pipe passes through the motor and for any given motor, there is an optimum flow rate along with minimum and maximum allowable flow rates. After passing through the motor, the drilling fluid passes through a drill bit or other cutting tool before passing back up the annulus of the wellbore around the drill string.

Downhole operations routinely encounter pump rate limitations due to surface pressures exceeding the capacity of the pumps or the tubing. High surface pressures can come from a variety of sources such as drilling fluid weight, frictional loss, well conditions and pump rate. This problem is exacerbated when the downhole tools being used create additional back pressure or have rate limitations. These tools, in addition to positive displacement motors, can include hydraulic tractors, and multi-lateral entry tools.

Substantial amounts of debris often need to be cleaned out of horizontal wells during drilling of bridge plugs following a hydraulic frac operation. This debris can include frac sand, pieces of plugs, and formation. Typically wiper trips are performed every one or two plugs in order to clean the horizontal section of the well. The speed of the wiper trips is usually dictated by the annular velocity of the fluid in the wellbore.

In certain instances, removal of the debris in the borehole annulus requires a drilling fluid flow rate greater than the maximum allowed flow rate through the motor and therefore there must be a means for diverting some of the drilling fluid from the bore of the drill string to the annulus at a point near, but just above, the motor or other downhole tool. This will prevent exceeding the maximum flow rate for the motor, while providing an adequate flow rate in the annulus to remove the debris.

Some tools are known for this and similar purposes which require the pumping of a ball downhole to block a passage in the fluid flow path, usually resulting in the shifting of some flow control device downhole to divert drilling fluid to the annulus. Such tools usually suffer from the disadvantage of not being returnable to full flow through the motor, in the event that reduced fluid flow becomes possible thereafter. Other such tools might employ a fracture disc or other release means, with these release means suffering from the same disadvantage of not being reversible. Consequently, there is a need for an improved tool which will reliably divert drilling fluid to the annulus to achieve increased pump rates and corresponding annular velocities of debris removal.

SUMMARY OF THE INVENTION

The present invention provides a tool that could open additional ports to annulus which allows the operator to achieve increased pump rates and corresponding annular velocities. The present invention includes a clean out sub capable of repeatedly opening and closing annular circulation ports to provide increased pump rates and corresponding annular velocities for the drilling fluid. The clean out sub has two distinct modes of operation, namely, annular circulation ports open and annular circulation ports closed. The clean out sub contains a valve spool that responds to differential pressure created across a fixed orifice. The force created by the differential pressure pushes the valve spool into a compression spring. The surface area of the spool that system pressure acts on is equal above and below the orifice. By doing this, the valve spool position is only affected by increasing or decreasing the flow rate and corresponding pressure drop created by the orifice. Changes in system pressure, such as back pressure created by motor work downhole of the clean out sub will have no effect on the valve spool position. At a predetermined flow rate the valve spool will move far enough to shut off pressure to the spring cavity. When the pressure to the spring cavity is shut off, the pressure area of the valve spool downhole of the orifice is reduced substantially because the spring cavity is vented to annulus through a bleed hole. This creates a large force imbalance on the valve spool which quickly overwhelms the spring force and causes the spool to rapidly shift revealing the annular circulation ports. The valve snapping open eliminates spool oscillation which is a source of potential wear. The annular circulation ports are angled uphole in a swirl arrangement to better lift debris off the bottom of the hole. The annular circulation ports will remain open until the pressure to the spring cavity is reintroduced at a predetermined pump rate. This will be at a considerably lower pump rate than when the clean out sub opens because of the pressure area imbalance on the spool. The valve hysteresis is beneficial for high pressure wells where an elevated pump rate is not possible. The operator can briefly increase the pump rate to shift the clean out sub, then reduce down to normal pump rate. The annular circulation ports will remain open and improved hole cleaning is achieved by the swirling fluid jetting from the ports.

Once the annular circulation ports are open there will be a pressure balance between the fluid continuing to go through the orifice and the fluid exiting the ports because they are located uphole of the orifice. The flow distribution of how much fluid exits the annular circulation ports can be controlled by the flow area of all the annular circulation ports relative to the cumulative restriction of the orifice and any tools below the clean out sub.

DETAILED DESCRIPTION

Figure 1:
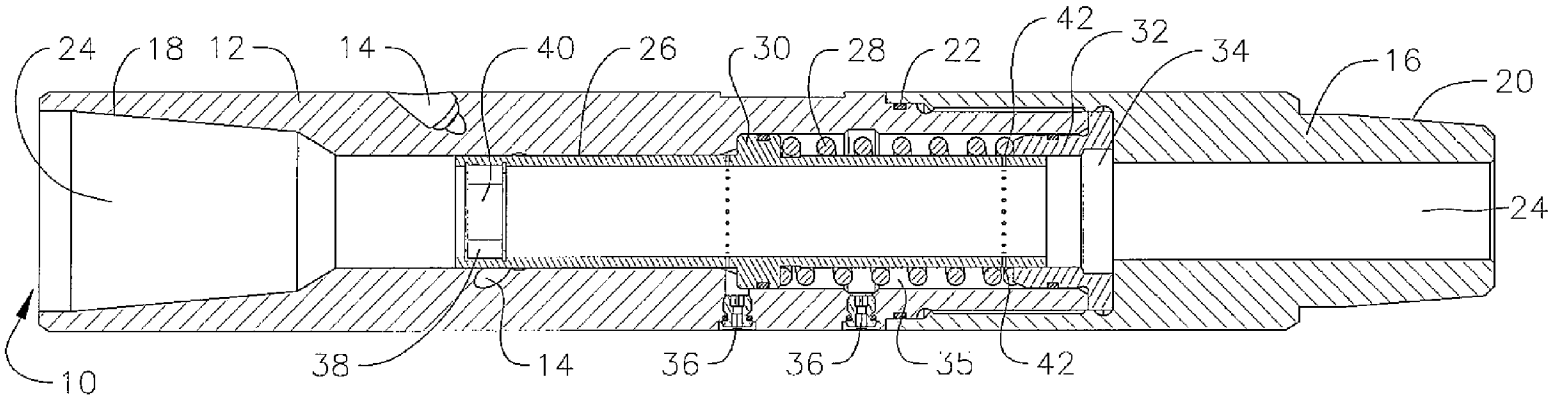
FIG. 1 is a cross-sectional view of the clean out sub of the present invention.

FIG. 1 illustrates a clean out sub 10 of the present invention. The clean out sub includes a cylindrical housing 12 having a plurality of annular circulation ports 14 positioned circumferentially around the housing 12. The ports are angled uphole in a swirl arrangement. The housing is connected to a tool joint 16, typically by being threaded together. The uphole end 18 of the housing is adapted to be attached to the drill string, typically by threading. Similarly, the downhole end 20 of the tool joint is also adapted to be connected to further drill string components, such as a motor, typically by threading. Similarly, the housing and the tool joint are connected to one another by threading. A seal 22 is positioned between the downhole end of the housing and the uphole end of the tool joint. A fluid passage 24 extends through the housing and tool joint. A valve spool 26 is positioned within the fluid passage 24 of housing 12 and a compression spring 28 is positioned around a portion of the valve spool within the housing 12. The compression spring 28 is retained between a flange 30 on the valve spool and a flange 32 surrounding a valve spool guide 34 positioned within the fluid passage of the tool joint 16. The spring 28 is contained within a spring cavity 35 between flanges 30 and 32. Annular bleed ports 36 extend through the housing into the spring cavity. A nozzle 38 is positioned on an uphole end of the valve spool and has a reduced diameter orifice 40. Spring cavity pressure supply ports 42 extend through the valve spool between the fluid passage and the spring cavity.

Figure 2:
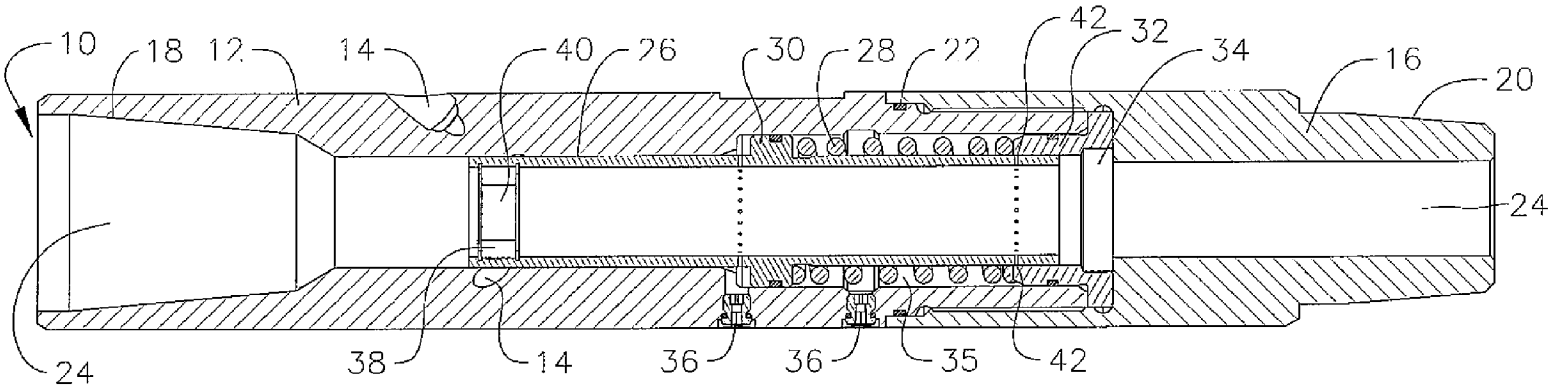
FIG. 2 is a cross-sectional view of the clean out sub of FIG. 1 illustrating the spring cavity vented to annulus.
Figure 3:
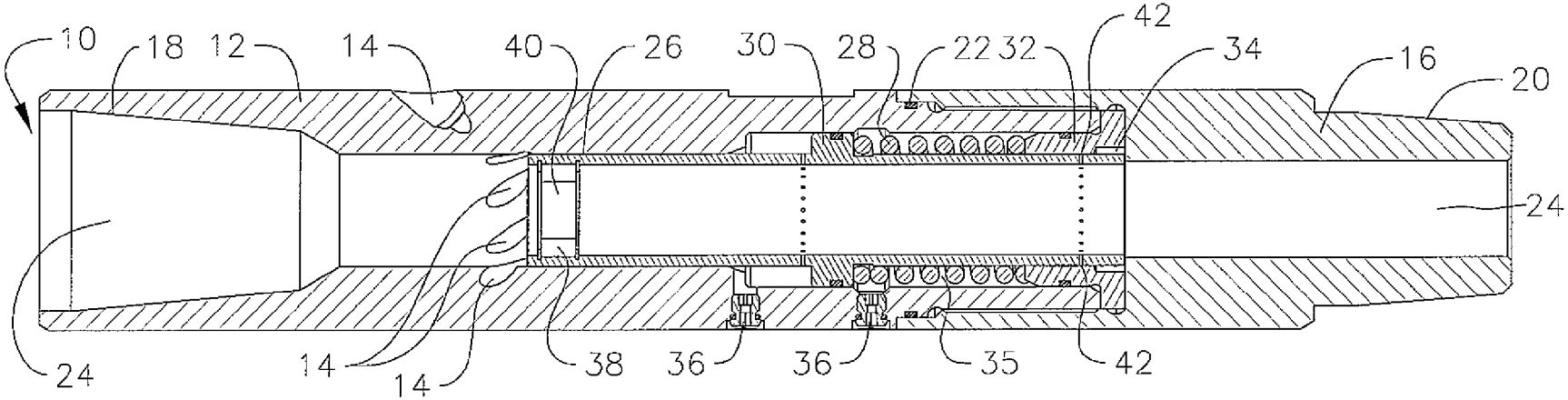
FIG. 3 is a cross-sectional view of the clean out sub of FIG. 1 in a full open position.

As drilling fluid passes through the clean out sub a pressure drop is created by the orifice which is integral to the valve spool and imparts a force on the uphole face of the valve spool. This force is reacted against the compression spring. At a predetermined flow rate, the force acting on the valve spool overcomes the installed force of the compression spring and the valve spool begins to move downhole as shown in FIG. 2. When the spring cavity pressure supply ports 42 in the valve spool are sealed off by the valve spool guide 34 as shown in FIG. 2, the spring cavity will be vented to annulus through the annular bleed ports 36. The valve spool will then snap open revealing the annular circulation ports 14 as shown in FIG. 3 and the drilling fluid can be diverted to the annulus to lift the debris to the surface.

In one exemplary embodiment of the present invention, the clean out sub 10 can be designed having an outside diameter of 2.88 inches, an inside diameter of 0.688 inches, a length of 16 inches and a flow rate of 0-6 BPM. Such an embodiment would be designed for a wide variety of coiled tubing operations including acidizing, sand washing, logging, moving sliding sleeves, drilling, running perforation guns, milling, and other typical operations performed in cased and open hole applications with restrictions of 3.00 inches or greater. A wide range of variations on size and performance can be achieved to meet a particular application. These variations include changes to orifice size, valve size, annular circulation port size for flow distribution, valve spring resistances based upon a particular set point, material selection and connection types.

The clean out sub may be installed in a bottomhole assembly as a single component or other components such as downhole motors, drill bits, milling bits, tractors, nozzle subs, various logging tools, perforation guns, sand washing tools, measurement while drilling tools, logging while drilling tools, and special actuation tools such as tools to move sliding sleeves. For example, the clean out sub can be used in combination with a motor and a drill bit to facilitate drilling of bridge plugs in casing. Typically a substantial amount of debris is left in the hole after a bridge plug has been drilled because pump rates are limited by pressure and the maximum rate the motor can handle. With the clean out sub in the bottomhole assembly, after the bridge plug is drilled through, the pump rate can be increased to open the annular circulation ports and improve hole cleaning while protecting the motor from damage. This process will result in a cleaner hole with the potential for improved production over a longer period of time.

In other examples, the clean out sub can be used in combination with a tractor and a nozzle sub wherein two distinct pump rates will be determined beforehand for when it is desirable to have the tractor on or off. When flow rates are at or below the tractoring rate, the clean out sub will remain closed and all pump fluid will be delivered to the tractor. When the flow rate exceeds a predetermined value, the clean out sub will open and the tractor will not operate. The tractor can be used to convey tubing past its lock up to various depths where the clean out sub can be opened to deliver stimulation treatments, injectivity tests, or perform hole cleaning.

Particular embodiments of the clean out sub can be used with rotary drill pipe to optimize fluid rates in tapered casing strings. The optimal circulation rate is substantially different when casing diameters change. The proper pump rate for 9⅝ inch casing is too high for casing that tapers to 7 inches. A clean out sub located in the tool string near the transition of casing sizes can allow some fluid to exit into the larger casing size. Multiple clean out subs can be installed to optimize flow rates if several casing sizes are used. A clean out sub can be used near the bottomhole assembly to protect sensitive equipment from harsh fluids and to facilitate dry tripping.

The materials used in the clean out sub include various corrosion resistant and erosion resistant materials. Stainless steel alloys are used in the tool joints and housing of the tool. MP35N or Elgiloy is used for the valve spring. Tungsten carbide is used in the valve spool and body. Seals are made from commercially available elastomers.

When the annular circulation ports are closed all fluid passes through the tool. Similarly, when the annular circulation ports are open, a path for the drilling fluid to annulus is opened. The annular circulation ports are located uphole of the orifice. The clean out sub can be actuated between an open and closed condition repeatedly. The clean out sub has hysteresis between its opening and closing rate which allows for use in a variety of well conditions. The materials of the clean out sub are made from acid resistant and non-magnetic materials. The clean out sub does not respond to increases or decreases in system pressure. The clean out sub can be used in conjunction with downhole tools that either respond to or produce back pressure. Surface pump rates are commonly reduced when there are downhole tools that produce a back pressure or have rate limitations. The clean out sub can be opened throughout the course of a job when a higher flow rate is desirable. The clean out sub can then be closed so that the other tools can resume their normal operation. A clean out sub can also be used with rotary drill pipe to optimize flow rates in various sizes of casings.

Figure 4:
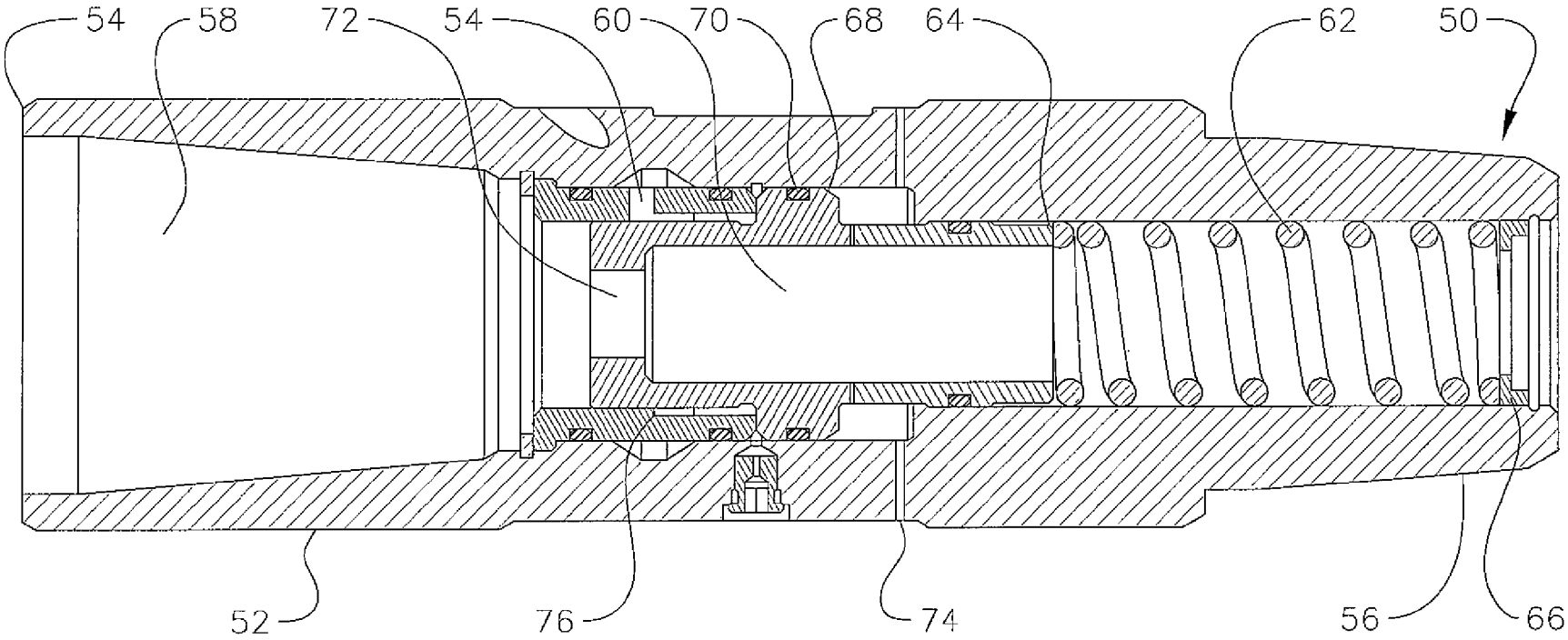
FIG. 4 is a cross-sectional view of an alternative embodiment clean out sub with annular circulation ports closed.
Figure 5:
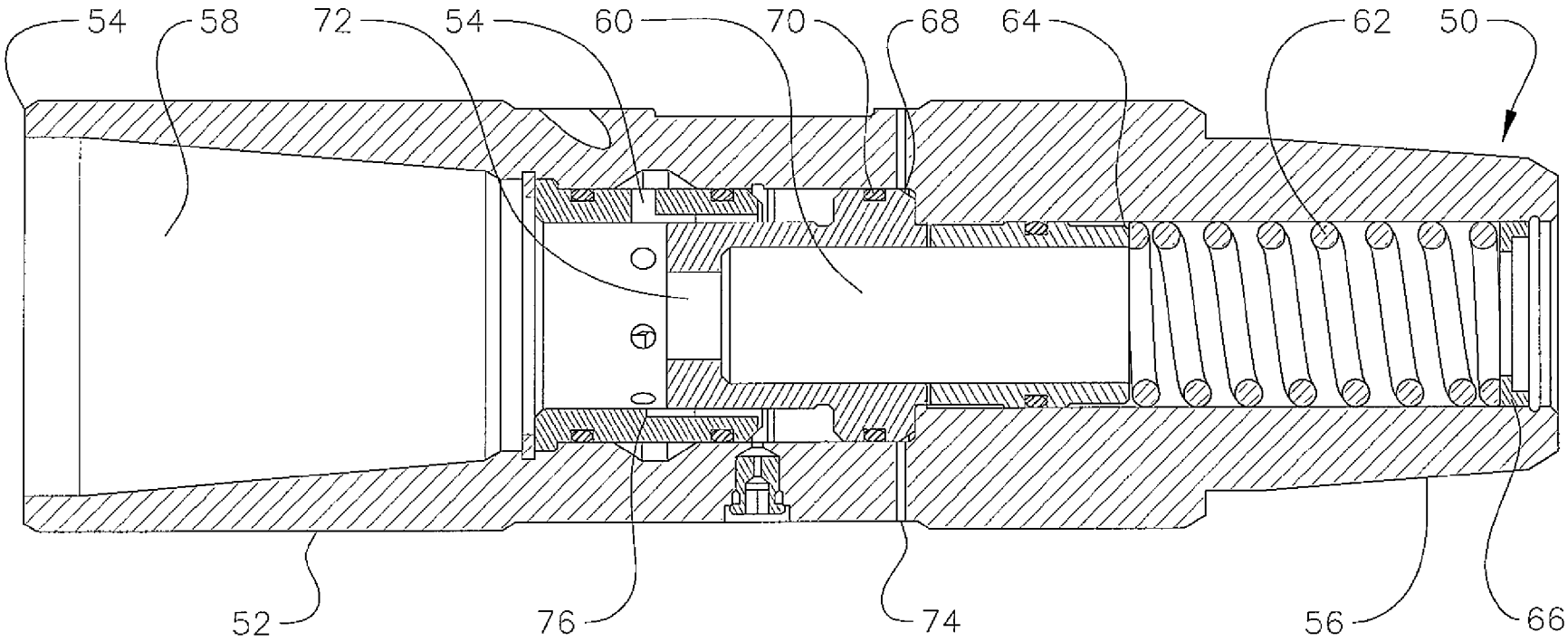
FIG. 5 is a cross-sectional view of the clean out sub of FIG. 4 with the annular circulation ports open.

FIGS. 4 and 5 illustrate an alternative embodiment clean out sub 50 of the present invention. Clean out sub 50 includes a cylindrical housing 52 having a plurality of annular circulation ports 54 positioned circumferentially around the housing 52. The ports are angled uphole in a swirl arrangement. The housing has a female uphole end 54 and a downhole male end 56 which are threaded to be attached to the drill string which can comprise drill pipe or other drill string components. A fluid passage 58 extends through the housing. A valve spool 60 is positioned within the fluid passage 58 of the housing and a compression 62 is positioned within the fluid passage adjacent the valve spool. The spring 62 is contained within the fluid passage of the housing by an end 64 of the valve spool and a retaining member 66 positioned adjacent the downhole end 56 of the housing.

The valve spool 60 has a flange 68 having an O-ring 70 for sealing the valve spool within the fluid cavity of the housing. The valve spool further includes a reduced diameter orifice 72 on an uphole end of the valve spool for admitting drilling fluid into the interior of the valve spool. Vent holes 74 extend through the housing and into the fluid cavity downhole of flange 68. A fluid passage 76 extends from the annular circulation ports to the flange 68 and is sealed to the O-ring 70 when the annular circulation ports are closed as shown FIG. 4.

During normal operation, the uphole and the downhole sides of the O-ring are both vented to annulus. The valve spool has equal pressure areas uphole and downhole of the orifice in order to only react to changes in flow rate rather than overall changes in system pressure. When a pressure drop across the orifice is enough for the valve spool to reveal the annular circulation ports 54, the pressure area of the valve spool is increased by allowing pressure to act against the uphole side of the O-ring through fluid path 76 creating a large force imbalance causing the valve spool to snap open as illustrated in FIG. 5 which eliminates oscillation.

Although the present invention has been described and illustrated with respect to example embodiments thereof, it is to be understood that changes and modifications can be made therein which do not depart from the scope of the invention as hereinafter claimed.

What is claimed is:

1. A clean out sub for use in a drill string comprising:

a tool body having a tool body cavity for passage of drilling fluid through the clean out sub;

a plurality of annular fluid circulation ports extending only through the tool body to vent some of the drilling fluid out of the tool body cavity;

a cylindrical valve spool positioned within the tool body cavity having an uphole end with a reduced diameter orifice;

a compression spring located within a spring cavity positioned between the tool body cavity and the valve spool;

spring cavity pressure supply ports extending through a lower end of the valve spool; and spring cavity bleed ports extending through the tool body and spaced from the spring cavity pressure supply ports;

wherein a drop in drilling fluid pressure created by the orifice imparts a downhole force on the valve spool and at a predetermined force overcomes a set resistive force of the compression spring thereby moving the valve spool to a downhole position to close the spring cavity pressure supply ports, vent the spring cavity through the spring cavity bleed ports and open the annular fluid circulation ports positioned uphole of the valve spool in the downhole position.

2. The clean out sub of claim 1 wherein the tool body includes housing portion and a tool joint portion.

3. The clean out sub of claim 2 wherein a valve spool guide is positioned within the tool body cavity adjacent the valve spool.

4. The clean out sub of claim 3 wherein the spring cavity is defined by a flange on both the valve spool and the valve spool guide.

5. The clean out sub of claim 1 wherein the valve spool has a nozzle containing the orifice, adjacent the annular fluid circulation ports in a closed position.

6. The clean out sub of claim 1 wherein the annular fluid circulation ports are angled in a swirl arrangement through the tool body to produce a swirling flow of drilling fluid therefrom.

7. A fluid bypass tool for a drill string comprising:

a tool body;

a flow control member is positioned within said tool body;

a fluid flow restriction is positioned within said flow control member;

a fluid passage extends from an upper end of said tool body, through said fluid flow restriction and said flow control member, to a lower end of said tool body;

a fluid path is positioned below said fluid flow restriction;

a plurality of annular circulation ports extend through a wall of said tool body, said annular circulation ports are positioned uphole said fluid flow restriction in said flow control port when said annular circulation ports are in an open position; and a biasing mechanism is positioned within said tool body, said biasing mechanism exerting a biasing force on said flow control member to place the annular circulation ports in a closed position;

wherein a drop in drilling fluid pressure through the fluid flow restriction imparts a downhole force on the flow control member to overcome the biasing force of the biasing mechanism thereby moving the flow control member to the annular circulation ports open position.

8. The bypass tool of claim 7 wherein said fluid control member comprises a cylindrical valve spool.

9. The bypass tool of claim 7 wherein said fluid flow restriction comprises a reduced diameter orifice in the valve spool.

10. The bypass tool of claim 8 wherein the biasing mechanism comprises a spring.

11. The bypass tool of claim 9 wherein the cylindrical valve spool has equal pressure area uphole and downhole of the orifice to only react to changes in fluid flow rate through the bypass tool.

12. The bypass tool of claim 10 wherein the spring is positioned around the valve spool.

13. The bypass tool of claim 12 further comprising vent holes which extend through the tool body wherein changing a pressure area of the valve spool in order to create a force imbalance causes the valve spool to open the annular circulation ports.

14. The bypass tool of claim 13 wherein the valve spool has a flange with an O-ring that is pressurized by fluid flowing through the fluid path.

15. A drill string tool, for cleaning debris out of an annulus between a drill string and a wellbore comprising:

a cylindrical housing having a plurality of annular circulation ports extending through the housing;

a valve spool having a flow restriction portion adjacent the annular circulation ports;

a biasing member positioned in a cavity between the housing and the valve spool downhole of the flow restriction portion biasing the valve spool to close the annular circulation ports; and cavity pressure supply ports extending through the valve spool;

wherein the valve spool responds to differential pressure across the flow restriction portion to move the valve spool to close the cavity pressure supply ports creating center line pressure to further move the valve spool to open the annular circulation ports.

16. The drill string tool of claim 15 wherein the biasing member is a spring.

17. The drill string tool of claim 15 wherein the flow restriction portion is a nozzle having a reduced diameter orifice.

18. The drill string tool of claim 15 further comprising cavity bleed ports extending through the housing.

19. The drill string tool of claim 15 further comprising a valve spool guide positioned in the housing adjacent the valve spool.

20. The drill string tool of claim 19 wherein the valve spool and the valve spool guide each have a flange for compressing the biasing member.

* * * * *